United States Patent [19]

Besik

[11] Patent Number: 4,834,285

[45] Date of Patent: May 30, 1989

[54] HEATING AND VENTILATING SYSTEM

[75] Inventor: Ferdinand K. Besik, Mississauga, Canada

[73] Assignee: Canadian Gas Research Institute, Don Mills, Canada

[21] Appl. No.: 148,313

[22] Filed: Jan. 25, 1988

Related U.S. Application Data

[63] Continuation-in-part of Ser. No. 25,478, Mar. 13, 1987, Pat. No. 4,708,000.

[30] Foreign Application Priority Data

Jun. 30, 1987 [CA] Canada ..... 541003

[51] Int. Cl.[4] ..... F24F 7/00

[52] U.S. Cl. ..... 237/48; 126/110 R; 126/110 C; 126/117; 237/55

[58] Field of Search ..... 237/48, 55; 126/110 R, 126/110 C, 117; 165/901

[56] References Cited

U.S. PATENT DOCUMENTS

| | | | |
|---|---|---|---|
| 649,251 | 5/1900 | Maude . | |
| 1,214,047 | 1/1917 | McGinnis . | |
| 1,660,689 | 2/1928 | Terry | 237/48 X |
| 1,727,540 | 9/1929 | Free | 237/48 X |
| 2,497,184 | 2/1950 | O'Brien | 237/50 |
| 4,034,482 | 7/1977 | Briscoe | 34/35 |
| 4,138,062 | 2/1979 | Graden | 237/55 |
| 4,163,441 | 8/1979 | Chen | 126/110 C |
| 4,175,538 | 11/1979 | McCarty | 237/48 X |
| 4,333,524 | 6/1982 | Elkins | 165/104.16 |
| 4,537,178 | 8/1985 | Hwang et al. | 126/110 R |

*Primary Examiner*—Lloyd L. King

*Attorney, Agent, or Firm*—Rogers, Bereskin & Parr

[57] ABSTRACT

A heating and ventilating system has a space heating device, in which heat is generated by combustion of a fuel, and which heats air for a building. A heat exchanger has one side through which exhaust air from the building flows to the exterior. Through the other side of the heat exchanger, fresh, makeup air for the building is supplied, and this may pass through the heater. An exhaust conduit from the heater, for combustion products, opens into the exhaust air line connected to the one side of the heat exchanger. This enables heat to be extracted from air leaving the building and further heat to be extracted from the combustion products, this heat being transferred to the incoming air in the heat exchanger.

23 Claims, 4 Drawing Sheets

HEATING AND VENTILATING SYSTEM

CROSS-REFERENCE TO RELATED APPLICATION

This application is a Continuation-In-Part of my earlier application 07/025,478 filed Mar. 13, 1987, now U.S. Pat. No. 4,708,000.

FIELD OF THE INVENTION

This invention relates to a heating and ventilating system for a building. This invention more particularly relates to a heating and ventilating system for a building, which includes a furnace in which a fuel is burnt or other space heating device to heat air within the building, and also a heat exchanger in which heat is transferred from air exhausted from the building to incoming exterior air.

BACKGROUND OF THE INVENTION

Recently, considerable attention has been paid to energy conservation in buildings, particularly domestic housing. Both the public and the housing industry have become aware of the desirability of energy conservation. Consequently, new standards of energy efficient housing designs and construction are being developed. These standards contain stringent energy efficient requirements, with respect to thermal insulation, air tight construction, space heating, space ventilation, water heating, controlled air management and passive solar design features.

This has led to the development of the R-2000 house. The amount of energy used by space heating systems in R-2000 houses dropped to as little as 1/10 of the energy used in conventional housing units. In some energy efficient designs, the demand for supplementary heat may be so low that a furnace becomes unnecessary.

Another somewhat surprising consequence is that, since the heating requirements are considerably reduced, there is little incentive to utilize or design highly efficient furnaces for such housing. The additional cost in making the furnace or space heating unit efficient is frequently considerable, but since the heating costs are in any event low, the economic savings from reduced fuel consumption may not be justified by the increased cost of the initial installation.

One way in which housing is made energy efficient is to make the house extremely air tight, so as to reduce leakage of heated air. However, it is now recognized that in any air tight house, provision must be made for a continuous, controlled exchange of indoor air with outdoor air, to avoid potential health and house damage problems from inadequate ventilation. In a proposed revision of the National Building Code of Canada (B. H. Dickens, "Controlled Ventilation and Housing", A Summary Review, 008-T5, Energy, Mines & Resources Canada, Dec., 1985), it is specified that a mechanical ventilation system must be provided, whether or not provision is also made for natural ventilation. In other words, reliance on natural ventilation is no longer acceptable. It is required that the mechanical ventilation system must have a minimum capacity of 0.5 ACH (Air Changes per Hour) for houses where natural ventilation for summer cooling is provided. In the absence of the capability for summer cooling, the capacity is required to be 1.0 ACH. The mechanical ventilation is required to be independent of any natural ventilation sources such as infiltration and flow through windows.

Currently, for energy efficient or R-2000 houses, the space conditioning services are provided by conventional space heating systems coupled with conventional ventilating systems and air-to-air heat recovery systems.

A variety of space heating systems are employed. For central systems, the energy source may be natural gas, oil or electric power, and the furnace may be conventional, high efficiency or an ultrahigh efficiency condensing type.

The ventilation of an R-2000 home is usually combined with recovery of heat from the exhausted air in a standard air-to-air heat exchanger equipped with defrost controls. At present, various types of air-to-air heat exchangers are used, with various effectiveness ratings. In a Canadian winter, at temperatures below freezing (0° C. to −20° C.), evaluation of various systems has shown the following disadvantages and loss of effectiveness:

(1) In solid core systems, of various materials, and both counterflow or double crossflow, severe frost buildup can cause up to a 50% drop in sensible heat recovery effectiveness and up to a 16% leakage of exhausted air into the fresh air supply and a significant drop in air delivery capacities;

(2) For current heat wheel concepts, severe frost buildup reduces sensible heat recovery effectiveness up to 22%, air delivery capacities are reduced by up to 34% and the leakage of the exhaust air into fresh air is up to 30%;

(3) For current heat pipe systems, measured sensible heat recovery effectiveness was in the range from 47–55%.

A major problem with existing air-to-air heat exchangers is the buildup of ice on the heat transfer surfaces affecting the heat transfer efficiency and air flow capacity. This depends on air stream temperatures and humidities, together with duration of the period of freezing and the system's design. For current air-to-air heat recovery systems, buildup of ice starts at temperatures below 26° F., although options for control of freeze-protection systems have been reported.

If one considers the requirements for space heating and ventilation of R-2000 houses, due to the high degree of their energy efficiency, the heating requirements are low. Thus, by way of example, for a 155 $m^2$ typical two storey house in a 6000 D.D. zone with 150 heating days per year, the average heat consumption would be 7,347 BTU/h. If one assumes a gas fired furnace which is operated for 50% of the time, then the required output of the furnace would be 14,695 BTU/h (which is equivalent to 94.8 BTU/h/$m^2$).

The guidelines for R-2000 houses further specify a ventilation requirement of a minimum of 0.45 ACH, which is to be provided by mechanical means. For a 155 $m^2$ house, the ventilating capacity would then be 102 SCFM. If one assumes a 70% effective air-to-air heat recovery system, for a 75° F. indoor temperature and a 0° F. outdoor temperature, the recovered sensible heat would be about 5,878 BTU/h and the sensible heat loss in the exhausted air would be about 2,519 BTU/h.

For the R-2000 housing design, the amount of heat involved is quite small. Accordingly, for an integrated heating-ventilating-heat recovery system, emphasis should be on reduction of overall capital costs and elimination of freeze up problems associated with the operation of the air-to-air heat recovery system at freezing outdoor temperatures.

The proposed revision of the NBC calls for mechanical ventilation in all future houses regardless of the type of construction. It is anticipated that new energy efficient housing will have a considerably higher heat load requirement than houses built to the R-2000 standards. The requirement for ventilation and air-to-air heat recovery will remain the same as those for the R-2000 housing.

However, the substantially higher heat load requirement for this group of new houses compared to the R-2000 housing may require that different designs be used in the two different groups of houses, even if the general requirement for conditioning of the occupied space of the two types of houses is the same.

In the heating and ventilating field, there have been numerous proposals for improvements in heating and ventilating systems, and the following U.S. patents were considered in the preparation of this application:

Re. 17,577 (Dryssen)
649,251 (Maude)
1,214,047 (McGinnis)
2,236,750 (Cross)
2,274,341 (Mueller)
2,497,184 (O'Brien)
2,891,774 (Theoclitus)
3,368,327 (Munters)
3,756,310 (Becker)
3,870,474 (Houston)
4,034,482 (Briscoe)
4,138,062 (Graden)
4,227,375 (Tompkins)
4,333,524 (Elkins)
4,398,590 (Leroy)
4,401,261 (Brown)

SUMMARY OF THE INVENTION

If the proposed revisions to the NBC are approved, requirements for space heating and mechanical ventilation will apply to all new housing. Consequently, air-to-air heat recovery will become an important feature in all housing.

It is therefore desirable to provide an integrated heating and ventilating system, which is suitable for both R-2000 houses and new housing made in accordance with the proposed new building code.

In accordance with the present invention, there is provided a heating and ventilating system comprising a space heating device in which heat is generated by combustion of a fuel for heating air within a building and which includes a heater inlet and a heater outlet for opening into the interior of the building, an exhaust conduit for the combustion products connected to the space heating device, a heat exchanger comprising one path for exhaust gases from the building interior which has one inlet and one outlet to the exterior, and another path for exterior air which has another inlet and another outlet connected to the heater inlet, and an exhaust air line connected to said one inlet for connection to the interior of the building and including a connection to the exhaust conduit of the space heating device, whereby the exhaust gases transferring heat to the incoming exterior air in the heat exchanger comprise exhausted interior air and combustion products.

The invention is expected to be particularly applicable to furnaces that heat air directly. The incoming air, heated by the heat exchanger, is passed through the furnace before entering the occupied space.

The heating and ventilating system can be applied to individual houses, large multi-unit residential buildings, or industrial buildings, with the individual components sized accordingly.

Where a building incorporates a water heater, or any other fossil-fueled device giving off combustion gases, then the combustion or flue gases can be combined with the exhaust air before passing through the heat exchanger. This enables further heat to be extracted from those flue gases, in addition to that extracted from the flue gases from the space heater.

BRIEF DESCRIPTION OF THE DRAWINGS

For a better understanding of the present invention, and to show more clearly how it may be carried into effect, reference will now be made, by way of example, to the accompanying drawings, which show a preferred embodiment of the present invention, and in which.

Figure 1:
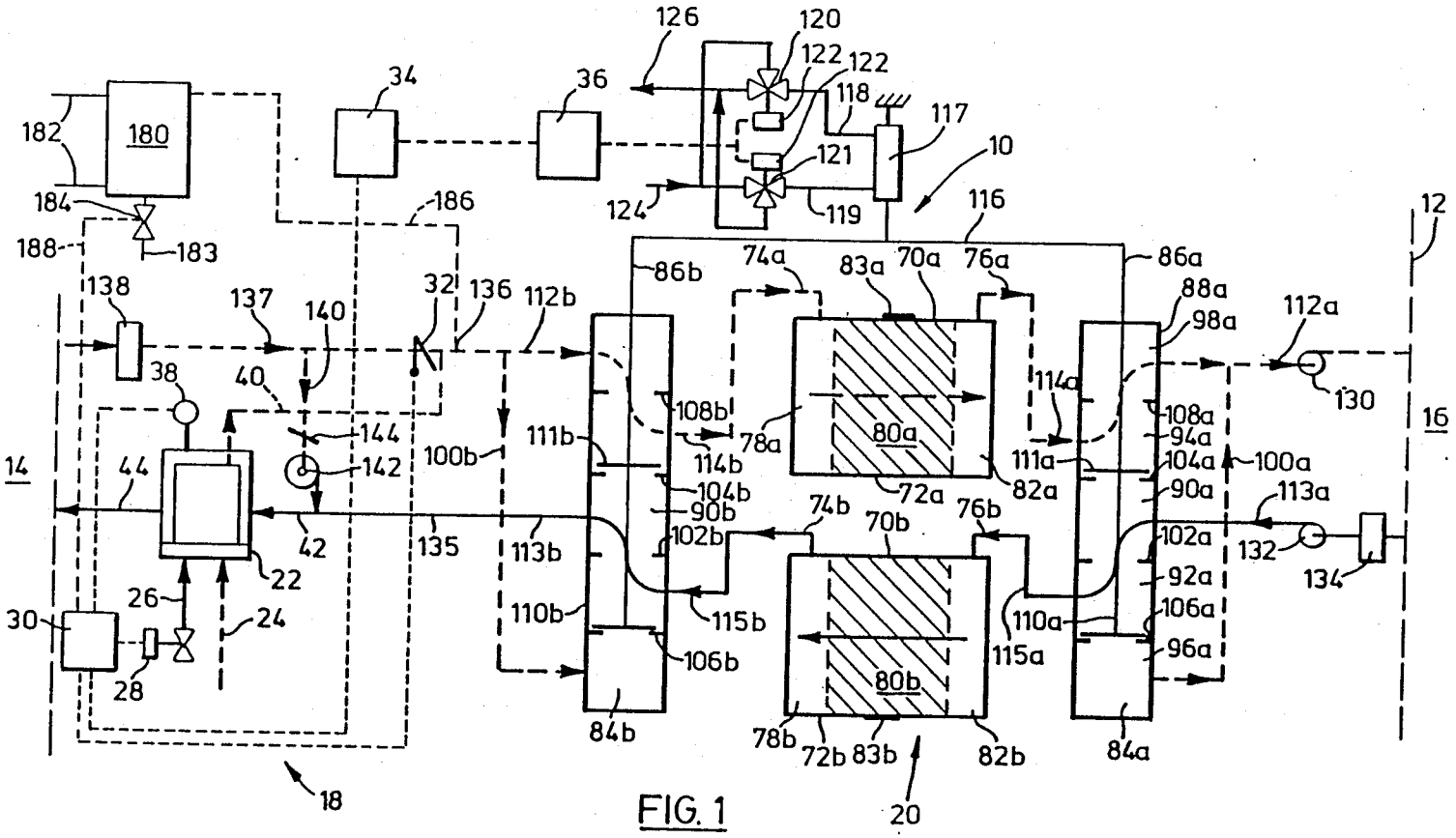
FIG. 1 is a schematic diagram of a heating and ventilating system according to the present invention.

Referring first to FIG. 1, the overall heating and ventilating system is designated by the reference 10. The system 10 is located indoors in the interior of a house, and a line 12 schematically indicates the separation between the interior and the exterior 16 of a house. The occupied or heated space is indicated schematically at 14.

The heating and ventilating system 10 essentially comprises two principal components, namely a space heater 18 and an air-to-air heat exchanger 20. The space heater 18 in this embodiment has a gas fired air heater 22. The air heater 22 includes an inlet 24 for air, which is drawn from the surrounding ambient air in the house. A line 26 is provided for fuel gas, and includes a control valve 28.

Combustion controls 30, can be largely conventional, and are connected to and control the valve 28. The combustion controls 30 are also connected to an air flow sensor 32 and via a temperature control unit 34 to an electronic solid state control unit 36. The unit 34 can be a conventional room thermostat and hence, although not shown, would be in the occupied space 14. A high temperature limit switch 38 is provided on the air heater 22, and is connected to the combustion controls 30.

The air heater 22 has an exhaust or outlet conduit 40, for the combustion gases. Additionally, it has a heater inlet 42 and a heater outlet 44, for the air being heated. The heater outlet 44 opens into the occupied space 14.

Figure 2:
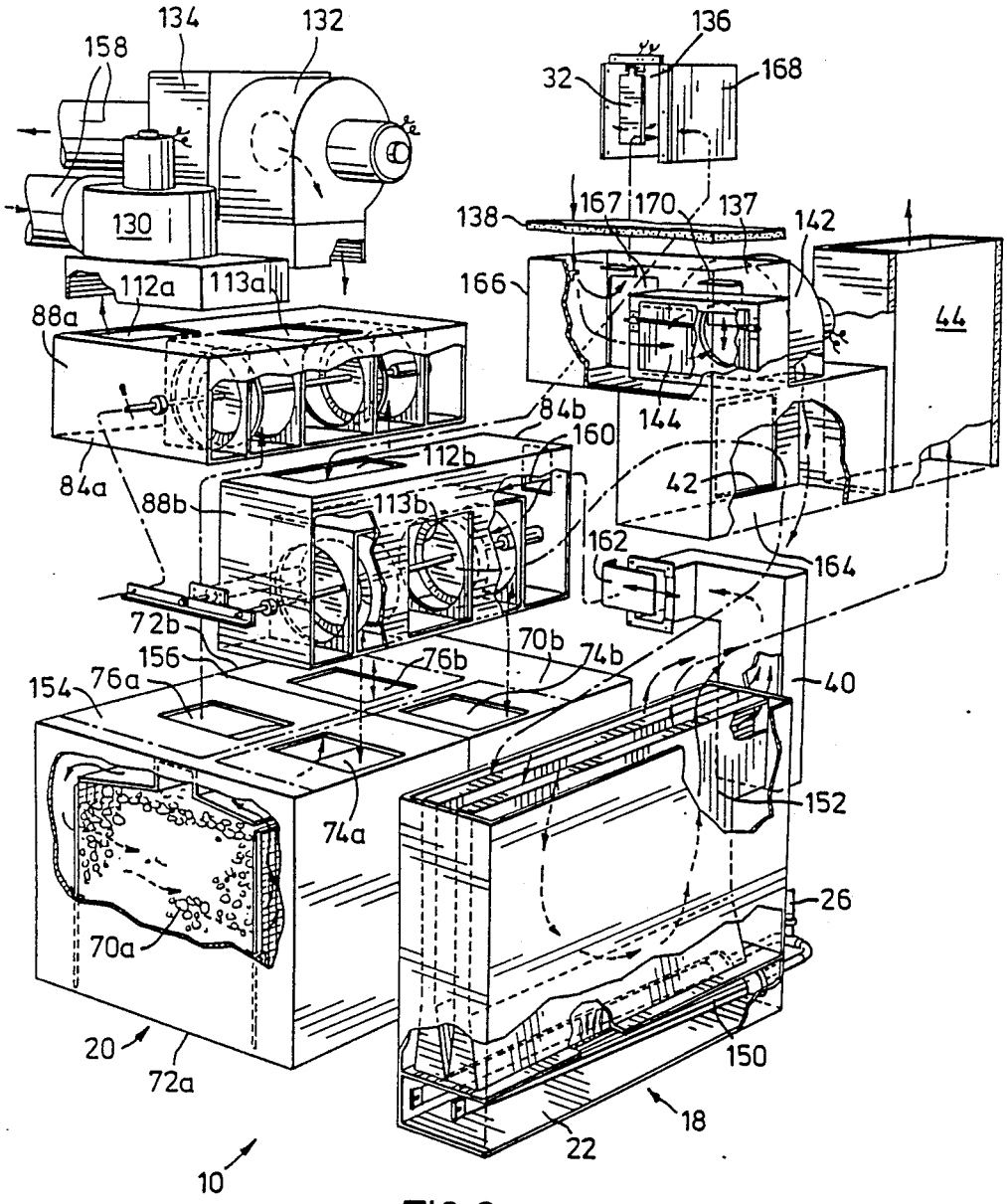
FIG. 2 is a perspective view from one side of the heating and ventilating system of the present invention, the view being partially exploded and partially in section.

The heat exchanger 20 comprises two regenerative beds 70*a*, 70*b*. The beds 70*a*, 70*b* are provided with similar containers 72*a*, 72*b*, which as shown in FIG. 2 are continuous and integral with one another. Each bed 70*a*, 70*b* has respective inlet/outlet openings 74*a*, 76*a*, 74*b*, 76*b*. In each bed 70*a*, 70*b*, there are three consecutive chambers. For the bed 70*a*, these chambers are one manifold chamber 78*a*, a central chamber 80*a* containing granular heat exchange material 71, and another manifold chamber 82a. The openings 74a, 76a open into the manifold chambers 78a, 82a respectively. Corresponding chambers 78b, 80b, 82b are provided for the other bed 70b. The chambers 78, 80, 82 are separated by perforated screens 73 that hold the bed material without impeding air flow.

To control the flow through the regenerative beds 70a, 70b, there are first and second four-way valves 84a, 84b. These are generally similar and are described in relation to the valve 84a, the corresponding components for the valve 84b having the suffix "b". The valve 84a is provided with an actuating rod 86a, which is slideably mounted in a housing 88a. The housing 88a defines five compartments, namely a central compartment 90a, a first inner compartment 92a, a second inner compartment 94a, a first outer compartment 96a and a second outer compartment 98a. The outer compartments 96, 98 are permanently connected within the housing 88a, as indicated at 100a.

The compartments 90a–98a are separated by interior partitions 102a, 104a, 106a and 108a. The partitions 102a–108a define openings providing communication between the corresponding compartments. These openings are generally circular.

The actuating rod 86 carries two closure members 110a and 111a. The closure 110a can abut either of the partitions 102a and 106a to close the corresponding opening, whilst the closure member 111a can abut the other two partitions 104a and 108a again to close the corresponding openings.

The outer compartment 98a has a first port 112a, whilst the central compartment 90a has a second port 113a. Similarly, the inner compartment 94a has a third port 114a, and the compartment 92a has a fourth port 115a. The third port 114a is connected to the inlet/outlet opening 76a and the fourth port 115a is connected to the opening 76b. The valve 84b has corresponding ports 112b, 113b, 114b and 115b; the third port 114b is connected to the inlet/outlet opening 74a, whilst the fourth part 115b is connected to the opening 74b.

The actuating rods 86a, 86b are connected to a common cross member 116. The cross member 116 is attached to the shaft of a hydraulic piston and cylinder assembly 117. This piston and cylinder assembly 117 has two inlet ports 118, 119, each connected to a respective three-way valve 120, 121. Actuators 122 for the valves 120, 121 are connected to the solid state control unit 36. An inlet line 124 for a pressurized operating fluid is connected to a port of each valve 120, 121. Similarly, an outlet line 126 is connected to a port of each of the valves 120, 121.

The piston and cylinder assembly 117 can be driven by any suitable hydraulic fluid source. Thus, the lines 124, 126 can be connected respectively to the output of a hydraulic oil pump and a hydraulic oil reservoir. For simplicity, the cylinder 117 could be driven by tap water, relying upon the pressure of the water to provide the necessary force. The water exhausted from the cylinder 116 would then simply be drained away.

The essential requirement for the cylinder 117 is that the closure members 110, 111 are moved fully between the respective partitions, and that at the end of the movement, a sufficient force is maintained to keep the closure members 110, 111 abutting the necessary partitions.

Whilst a hydraulic piston and cylinder assembly 117 is shown, other actuators are possible. For example, a solenoid or linear motor could be employed.

In FIG. 1, the closure members 110, 111 are shown abutting the partitions 104, 106. In this position, a pressure is maintained at the inlet port 118 of the hydraulic actuator 117. To move the closure members, the inlet port 118 is connected by its valve 120 to the discharge line 126. Simultaneously, the inlet line 124 is connected by the valve 121 to the inlet port 119. This causes the actuating rods 86, together with the closure members 110, 111, to travel upwards, as viewed in FIG. 1. The closure members 110, 111 are then urged against the partitions 102, 108. Again, a pressure is maintained at the inlet port 119, to maintain the closure members 110, 111 in this position. To return the closure members 110, 111 to the position shown in FIG. 1, the valves 120, 121 are operated, so that the inlet line 124 is connected to the port 118 and the discharge line 126 to the port 119.

The 4-way valve 84a has its first port 112a connected to the two outer compartments 96a, 98a, the connection including the permanent connection 100a. The first port 112a of the valve 84a is connected by a first, exhaust blower 130 to the exterior 16. Similarly, a second, inlet blower 132 is connected between the exterior and the second port 113a. An air filter 134 is provided for the blower 132 and port 113a.

For the second valve 84b, its first port 112b is connected to an exhaust air line 136. A return air line 13 is connected between the heated space 14 and the exhaust air line 136. An air filter 138 is provided at the entrance to the return line 137. The exhaust conduit 40 opens into a junction between the lines 136, 137 downstream of the flow sensing switch 32 provided in the line 136. The second port 113b is connected by an incoming air line 135 to the heater inlet 42.

A recirculation line 140 is provided extending from a junction between the return air line 137 and the exhaust line 136 to the heater inlet 42. The recirculation line 140 includes a third, recirculation blower 142 and a damper or non-return valve 144. The non-return valve 144 only permits air flow from the line 137 to the heater inlet 42.

The system can, additionally and optionally, include a gas-fired water heater 180, having input and output pipes 182. Like the space heater 18, the water 180 includes a gas supply line 183, including a control valve 184. The heater 180 could be otherwise conventional and would include its own internal control valve, thermostat etc. The control valve 184 is connected to the combustion controls as shown by line 188, to provide a primary control over gas supply to the water heater 180. The heater 180 has a second, exhaust conduit 186. This conduit 186 is connected to the exhaust line 136 downstream from the flow sensor 32. The conduits 40, 186 could join, before connecting to the exhaust air line 136.

Figure 3B:
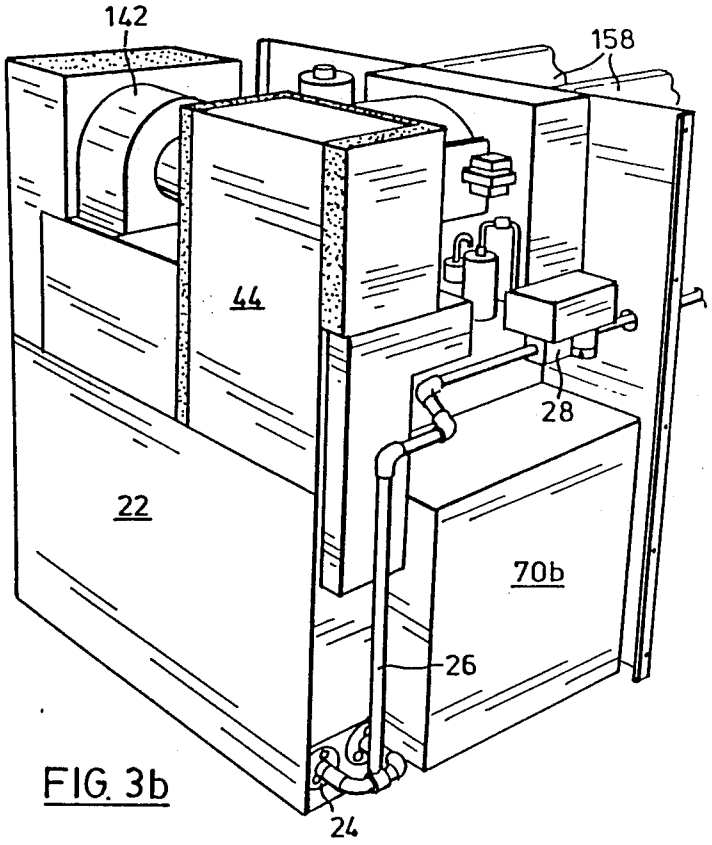
FIG. 3*b* is a perspective view from another side of the heating and ventilating system of FIG. 2.
Figure 3A:
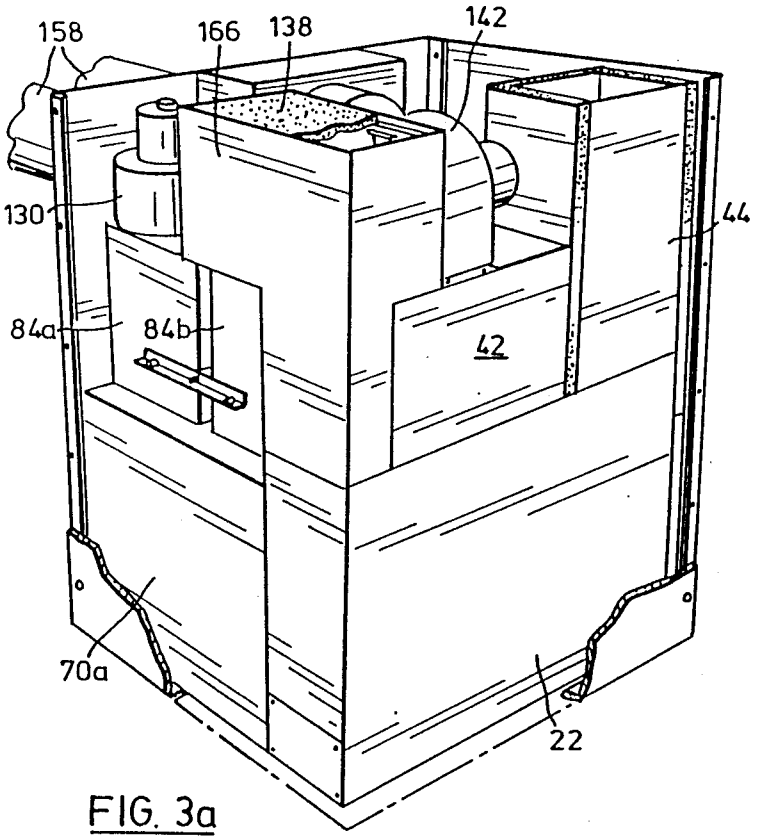
FIG. 3*a* is a perspective view similar to FIG. 2.
Figure 4:
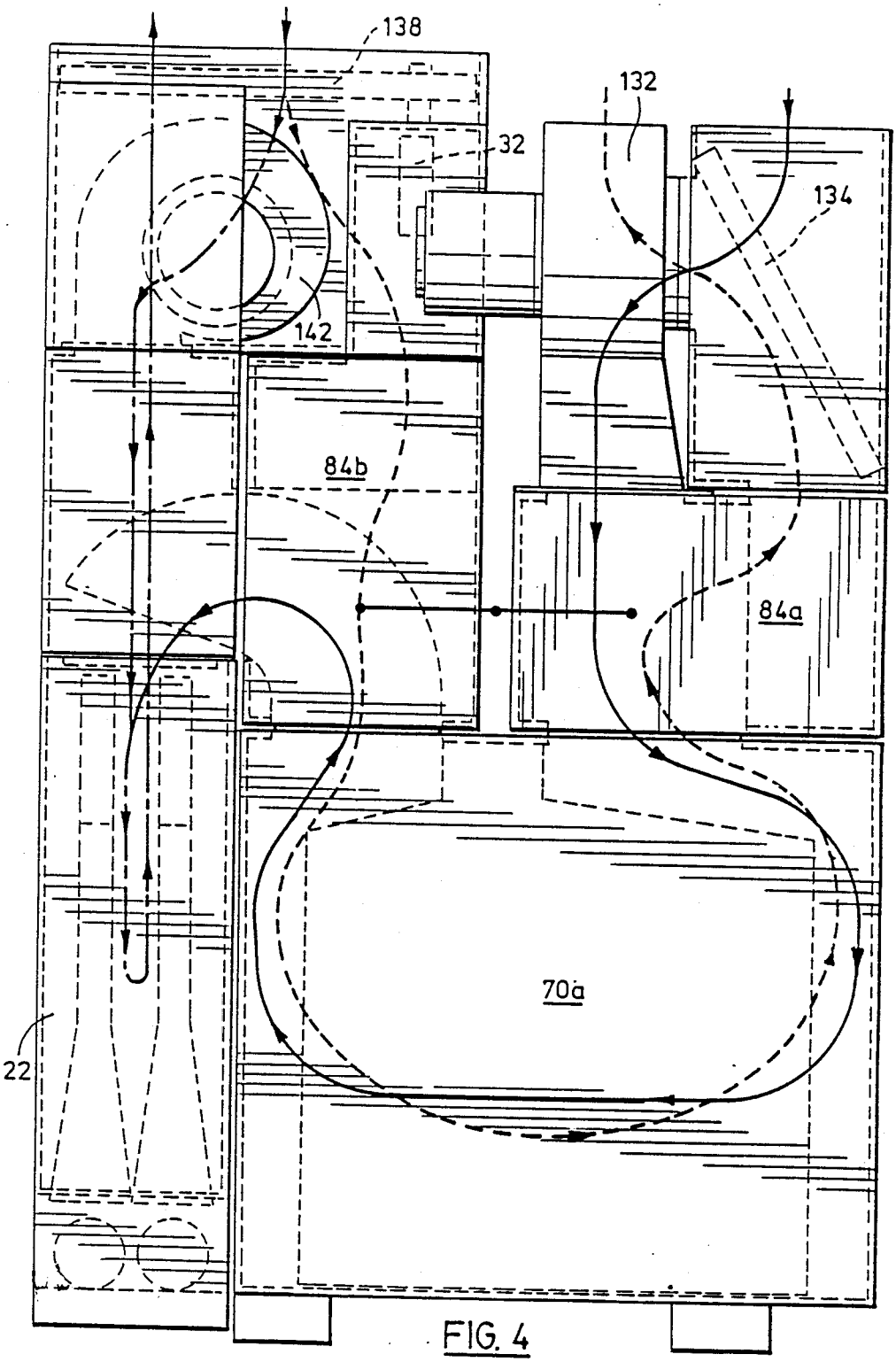
FIG. 4 is a vertical sectional view through the heating and ventilating system.

Having described the basic structure of the system in relation to FIG. 1, the apparatus will be described in greater detail, with reference to FIGS. 2, 3 and 4, which show the system with only the space heater 18 and not the water heater 180.

The gas fired air heater 22 has burners 150 and a clam shell heat exchanger 152. The burners 150 can be of conventional construction. The air hearer 22 can be provided with electronic ignition and intermittent pilot.

The electronic solid state control unit 36 includes a variable solid state ON OFF timer and relays interconnected with the combustion controls 30. The actual circuits of these components, and the relays, are not given in detail, since they can be largely of known construction and a variety of different circuits can be used.

The cycle time for the valves 84a, 84b can be varied in the range of, for example, 1–100 minutes.

The heater 22 is located at the front and bottom of the system 10, as viewed in FIG. 2. It extends across the width of the system 10. At the rear, the heat exchanger 20 is provided. The two regenerative beds 70a, 70b are provided in a common housing 154. The beds 70a, 70b are separated by a central bulkhead 156.

The heat exchange material of the beds 70a, 70b may be a ceramic or brick pieces, stone gravel, or pebbles. Alternatively, the material in the beds can be any standard ceramic, metallic or plastic packing, such as pall rings, raschig rings, berl or intalox saddles, or tellerets. Preferred size range of the gravel or pebbles is in the range ½" to 1".

The cross-sectional flow area of the beds 70a, 70b is selected to provide an acceptable pressure drop, which in turn depends upon the gas velocities. The frontal gas velocities of the entering air streams are preferably in the range 100–300 per minute. The depth and overall size of the beds 80a, 80b is selected to give the desired thermal effectiveness, and depends on the flow rate, temperature and humidity of the incoming air and on the duration of the operating cycle. Flanged openings 83a, 83b, shown schematically in FIG. 1, can be provided, to give access to the interior of the central chambers 80a, 80b. This allows the heat exchange material to be replaced, or cleaned.

The inlet/outlet openings 74a, 74b 76a, 76b are provided in the top of the housing 154 as indicated.

The 4-way valve 84a is provided at the rear of the whole assembly. The housing 88a of the valve 84a is formed from sheet metal and, although not shown in FIG. 1, encloses the permanent connection 100a, which runs alongside the separate compartments. The housing 88a additionally defines the ports 112a, 113a, on the top of the valve and the ports 114a, 115a on the bottom of the valve. Within the housing 88a, the partitions at 102a, 108a are generally square with circular openings. The closure members 110a, 111a are circular and are provided with annular seals on either side thereof.

The blowers 130, 132 are centrifugal blowers, and are mounted on top of the housing 88a. The duct work connecting the blowers 130, 132 to the exterior is indicated at 158.

The second valve 84b generally corresponds to the first valve 84a. Again, although not shown in FIG. 1, the housing 88b includes the permanent connection 100b which for this valve is located above the corresponding compartments. On its top surface, the housing 88b defines the first port 112b, whilst the second port 113b is defined on the side face. The ports 114b, 115b are on the bottom of valve 84b. The internal construction of the valve 84b is similar to that of the valve 84a.

Additionally, the housing 84b defines a smaller opening 160 at one side. As detailed below, this opening 160 provides a connection for the exhaust conduit 40.

Further details of the heat exchanger 20 are given in our copending application number The exhaust conduit 40 is provided at one side of the clam shell heat exchanger 152. It includes an adjustable baffle 162 for controlling the flow rate through it. The opening 160 thus enables the exhaust conduit 40 to be connected to the connection 100b, and hence effectively into the exhaust air line 136 connected to the port 112b.

The heater outlet 44 is provided in the form of a rectangular section vertical duct extending up from the clam shell heat exchanger 152, at one end thereof. At the other end of the clam shell heat exchanger 152, there is a duct section 164, also of generally rectangular section, forming the heater inlet 42. The heater inlet 42 abuts the second port 113b, so that the central compartment 90b communicates through the opening 113b, and the duct section 164 to the clam shell heat exchanger 152.

On top of the duct section 164, there is the exhaust air line 136 and return air line 137. The line 137 is defined by a housing 166, which again is of generally rectangular section. The housing 166 includes a side opening 167, opening into a side part 168 which defines part of the exhaust line 136. The flow sensor 32 is mounted to the side part 168, which in turn opens into the first port 112b. The flow sensor 32 is in the form of a switch actuated by a plate occupying a large part of the flow cross-section so as to be deflected by the air flow. The housing 166 is open at the top, to provide an inlet for air from the house. The filter 138 is provided across the top of the housing 166.

The third, recirculation blower 142 is mounted on the duct section 164 and opens into it. It has an inlet with a second adjustable baffle 170. The non-return valve or damper 144 is provided in a part extending into the housing 166. The valve 144 comprises a plate pivotally mounted about a horizontal axis adjacent the top thereof. The plate 144 is suspended so as to permit air flow to the blower 142, but preventing air flow from the blower 142 into housing 166.

Thus, the housing 166 and side part 168 provide communication from the occupied space 14 to the port 112b. Also, communication is provided from the interior of the house through the blower 142 to the heater inlet 42.

The various air ducts or conduits can be constructed of steel or other suitable material. They should be of a large enough flow area to minimize flow resistance. Similarly, in known manner, they should be insulated where appropriate. In particular, the exhaust conduit 40 from the heater 22 can be insulated. The heater inlet and outlet 42, 44 would be connected to a standard distribution network within a house. Thus, the outlet 44 would be connected to a number of distribution outlets throughout the house, whilst the inlet 42 would be connected to a, usually, smaller number of air return inlets.

The heating and ventilating system just described can be used either in a heating mode as an energy efficient balanced heat recovery ventilator/heater, or in a ventilating mode as a highly energy efficient balanced heat recovery ventilator. A description of the heating mode is given first, followed by a description of the ventilating mode.

During the heating mode, the temperature control unit 34 activates the heater 22 when the temperature of the heated space 14 falls below a set value. The burners 150 of heater 22 receive fuel via line 26 and valve 28 and combustion air via line 24, to generate heat in the clam shell heat exchanger 152. Return air withdrawn from the occupied space via return air line 137 and filter 138 is drawn by recirculation blower 142 through the recirculation line 140, to be mixed with fresh air preheated from one of the regenerative beds 70a, b. The mixed air passes to the air heater 22, where it is heated. While in heater 22, the air is heated up to about 180° F., whilst the combustion products are cooled down to about 300° F.–400° F. The heated air is then forced by blowers 132, 142 into the occupied space 14 to provide the required heating and fresh air, while the cooled combustion products are drawn out of the heater 22 via exhaust conduit 40 into exhaust line 136 by exhaust blower 130.

Simultaneously, the water heater 180, if present and operative, sends combustion gases through the second exhaust conduit 186 to the exhaust air line 136.

The exhaust blower 130 draws stale or exhaust air from the return line 137 through the exhaust line 136 where the exhausted stale air is mixed with the combustion products from conduits 40, 180. The mixture of stale air and combustion products is then drawn into and through the 4-way valve **84*b* and inlet/outlet opening 74*a* into the manifold chamber 78*a*. The air then passes through the screen and horizontally through the packed bed in the central chamber 80*a*, and into the manifold 82*a*. The air leaves through inlet/outlet opening 76*a* and passes through 4-way valve 88*a* and through the first port 112*a* to the exhaust blower 130. Finally the air is forced by exhaust blower 130 out to the exterior 16**.

The flow sensor 32 monitors the air flow through the exhaust air line 136, to ensure that this is sufficient to carry out combustion gases from the conduits 40, 180. In the event there is insufficient air flow, the sensor 32 sends a signal to the combustion controls 30, which then close the gas control valves 28, 184, to prevent combustion gases passing in the reverse direction through line 137 to the occupied space 14.

Simultaneously, the cool outdoor air is drawn by blower 132 through the filter 134, and then forced via second port **113*a* into and through the 4-way valve 84*a*. The air then flows via the inlet/outlet opening 76*b* into the manifold chamber 82*b*, then through the screen, horizontally through the packed bed in the central chamber 80*b*, through the screen into the manifold chamber 78*b* and then out through the inlet/outlet opening 74*b*. The air then passes through 4-way valve 84*b*, then via incoming air line 135 into heater 22, and is mixed with circulated air from the recirculation line 140**.

During the time the actuating rods **86*a*, 86*b* remain in the position of FIG. 1, the bed 70*a* is being heated by absorbing heat from the exhausted mixture of stale air and combustion products which mixture in turn is being cooled from a higher entering temperature to a lower exiting temperature. The heated packed bed material has the highest temperature adjacent the manifold chamber 78*a* and the lowest temperature adjacent the manifold chamber 82*a***.

Simultaneously, the bed **70*b* is being cooled by the cool fresh air flowing horizontally through it and countercurrently with respect to flow of exhausted stale air. As the bed 70*b* is releasing the previously absorbed heat and moisture, the fresh air is humidified and heated from its low entering temperature to its highest temperature at which it exits from packed bed 70*b***.

During the described period, when the bed **70*a* is being heated and packed bed 70*b* is being cooled, the temperature of the cooled exhausted air leaving packed bed 70*a* is slowly rising, while the temperature of the heated fresh air leaving the heated bed 70*b* is slowly dropping. These temperature swings can be controlled by the duration time of the operating cycle. Consequently, by controlling the duration time of the operating cycle one can control the temperature of the exhausted air leaving the packed bed heat exchanging material and thus prevent the buildup of ice in the regenerative beds 70*a*, 70*b***.

When the actuating rods **86*a*, 86*b* move from the position shown in FIG. 2 into a position where the closure members 110, 111 abut the partitions 102, 108, then the two air streams are switched between the two beds 70*a*, 70*b*. The mixture of exhausted stale air and flue gases now is drawn through the regenerative packed bed 70*b* while the cool fresh air is now forced through the bed 70*a*. The previously heated bed 70*a* now gives up its heat and moisture to the incoming air stream. The previously cooled bed 70*b* now is heated and absorbs moisture from the exhausted air. Thus eventually an operating cycle of heating and cooling for each of the two packed beds 70*a*, 70*b* is completed. The two halves of the operating cycle are of equal duration. Since changing the position of the two actuating rods 86*a*, 86*b* between their end positions takes only a fraction of a second, the flow of the two air streams is essentially continuous. Since the exhausted stale air and flue gases during the heating period flow through packed beds 70*a*, 70*b*** countercurrently relative to flow of the fresh air during the cooling period, the heat and moisture transfer between the two air streams is perfectly countercurrent.

Since the mixture of stale air and combustion products flows through the apparatus under negative pressure induced by the exhaust blower 130, while the fresh air is forced through the apparatus under positive pressure by the blower 132, contamination of the fresh air with combustion products due to potential leaks is virtually eliminated. When the flow is switched between the beds **70*a*, 70*b*, a residual amount of exhaust air will be stored in one bed and then entrained in the fresh air coming in through that bed. Compared to the total volume of air passing through the regenerative beds 70*a*, 70*b***, this residual quantity of exhaust air is negligible, and any flue gases are heavily diluted by exhausted stale air.

The assembly can also be used in the ventilating mode. In this case, the gas line 26 and combustion air line 24 are closed. The blowers 130, 132 then serve to exhaust air from the structure at the same rate at which fresh air is forced into the structure. During this operation, flue gases from a water heater 180 can be exhausted and combined with the exhaust air. During this process, the regenerative beds **70*a*, 70*b* are cycled as described above. This ensures that even for a different external temperature, there should be no large net heat loss from the structure. This ventilating mode could also be used, where the external temperature is higher. In this case, the regenerative beds 70*a*, 70*b*** should serve to reduce the heat input into the structure, which would otherwise result from the exchange of internal air for fresh external air.

During the ventilating mode, the recirculation blower 142 can be shut down, depending on the amount of additional circulation required in the structure.

It should also be understood that, in case the required heating load is small, it may be possible to eliminate the recirculation blower 142. Thus, where the flow of fresh incoming air is sufficient to absorb the heat input, as generated by the space heater 18, then it is not necessary to provide an additional recirculated air flow to transport this heat into the house structure.

Thus, the combination of the heat exchanger 20 and the valves **84*a*, 84*b*, provides two paths between the exterior. One path connects the exhaust gas line 136 to the exhaust blower 130, whilst the other path connects the inlet blower 134 through to the heater inlet 42. The paths are switched between the two beds 70a, 70b, by the valves 84a, 84b. The ports 112b, 112a provide respectively one inlet and one outlet of the one path for exhausted air, whilst the ports 113a, 113b** respectively provide another inlet and another outlet for the other path.

To evaluate the efficiency of the combined heating and ventilating system from experimental data, it is necessary to determine what parameters are to be measured and how the efficiency of the combined unit is to be defined. In determining the steady state efficiency of gas fired furnaces and other heaters used for space heating, a standard practice is to determine heat loss from the heating unit with respect to room temperature.

In a case in which the space heater is combined with an air-to-air heat exchanger, it is more practical to determine the heat loss from the combined unit with respect to the outdoor temperature. Obviously for lower outdoor temperatures, the heat loss will be larger and the calculated efficiency lower than that calculated with respect to room temperature.

Another consideration is that the standard gas fired furnace is only providing sensible heat by heating the recirculating air without affecting air humidity. The furnace humidifier is not included in the discussion. However, the combined heating and ventilating system affects the humidity of the room air through ventilation and by transfer of moisture in the air-to-air heat exchanger from the exhausted room into the fresh outdoor air.

Accordingly, it is necessary to determine (a) the energy utilization efficiency of the combined unit in delivering heat energy into the occupied space, and (b) the efficiency with which such delivered heat is used for heating of the occupied space.

In order to determine the overall effectiveness and efficiency of the integrated heating and ventilating system of the present invention, parameters were developed indicative of the efficiency of the overall system. For this purpose, the following three principal parameters were developed, namely: the Space Heating Efficiency (SHE); the Combined Fuel Efficiency (CFE); and Moisture Removal rate per Day (MRD). These are discussed below, primarily in relation to a system without a water heater.

The space heating efficiency (SHE) is defined as follows:

$$SHE = \frac{\text{HEAT USED FOR HEATING OF THE OCCUPIED SPACE}}{\text{TOTAL FUEL ENERGY INPUT } (Q_F)} \quad (Q_U)$$

The assumption is made that all useful heat delivered into the occupied space is generated by combustion of fuel ($Q_F$), i.e. passive solar heat and human generated heat are considered negligible. It is also assumed that the fuel energy ($Q_F$) is used to: (a) heat the occupied space; (b) evaporate water to maintain the humidity of the air in the occupied space at the desired level; and (c) cover ventilation heat loss.

The useful heat ($Q_U$) is that portion of the heat delivered into the occupied space that is used for heating of occupied space and subsequently is lost through the building structure by conduction through walls, i.e. it does not include the heat lost due to ventilation of the occupied space and the heat used to humidify the air.

The combined fuel efficiency as defined as follows:

$$CFE = \frac{\text{HEAT ENERGY DELIVERED TO OCCUPIED SPACE}}{\text{FUEL HEAT ENERGY } (Q_F)} \quad (Q_D)$$

The heat energy delivered into the occupied space ($Q_D$) is equal to the heat content of the incoming air minus the heat content of the air taken from the occupied space, these heat contents including the enthalpy of the moisture in the air.

It will be appreciated that the heat energy delivered into the occupied space may be used not only to heat the occupied space, but also to evaporate water or to humidify the room air. The amount of heat energy used to humidify changes from situation to situation depending on conditions such as use of humidifiers, baths, watering of flowers, air tightness of the occupied space, etc. The energy used in evaporating water does not contribute to heating of the occupied space. Consequently, in practice, the energy used for heating of the occupied space is always less than the energy delivered into the space by the combined heating and ventilating unit. To determine with what efficiency the delivered energy is used for space heating, space heating efficiency is defined.

From the above discussion it follows that:

$$Q_D = Q_U + Q_E$$

where $Q_E$ is the portion of the delivered heat energy used to humidify the room air.

By definition, $CFE = Q_D/Q_F$ and $SHE = Q_U/Q_F$

Therefore:

$$CFE = SHE + Q_E/Q_F$$

The parameter MRD (moisture removal per day) is simply defined by MRD = moisture removed lb $H_2O$/-day.

Where the water heater 180 is present, this will need to be taken into consideration. Thus, $Q_F$ should include the additional fuel used by the heater 180, whilst $Q_D$ should include heat transferred to the water in the water heater.

Initial tests were run using a combined or integrated heating and ventilating system similar to that described above. However, the recirculation line 140 was omitted and the water heater 180 was not present. Thus, as mentioned above, this was a system intended for highly energy efficient housing, where a relatively low heat input is required. The gas fired air heater 22 had a clam shell heat exchanger with a capacity of 5,000–20,000 BTU/h. Two experimental models were built and tested in applicant's laboratory. The first model was built and tested during the fall and winter of 1985, and the second during spring and summer of 1986.

In terms of air flow characteristics, the models were essentially identical. It is noted that the first model was equipped with a linear electric motor to drive the 4-way valves 86a, 86b. However, this generated unacceptable valve impact noise, and did not provide the force necessary to maintain the valves sealed in their operating positions. Accordingly, in the second model, this actuator was replaced by an hydraulic cylinder, and the air circulation revised to eliminate leaks.

The results of runs carried out on the first model are summarized in Table 1, whilst those carried out on the second model are summarized in Table 2, these tables being set out at the end of the disclosure. The following conclusions can be deduced from the data in these tables.

The sensible heat transfer effectiveness ($E_{XS}$) of the regenerative air-to-air heat exchanger depends on the properties of the packed bed material, packed bed dimensions, operating cycle time and flow rates of the two air streams. For a given set of design parameters, $E_{XS}$ can be varied by varying the operating cycle time and the ventilation air flow rates. For both models 1 and 2, $E_{XS}$ could be varied between 0.6 to 0.85 by changing the operating cycle time from 10–30 minutes. When the cycle time or the ventilation air flow rate are increased, the effective $E_{XS}$ drops. More details on the air-to-air heat exchanger can be found in our copending patent application, mentioned above.

For gravel beds, moisture can be transferred between the two air streams only at conditions when the moist air stream is at or below its average dew point. The mechanism involves condensation of moisture on the surface of the packed bed material as well as condensation in the bulk air stream with a portion of the condensed moisture being retained by the packed bed material and a portion being discharged as a fog in the bulk air stream. To determine the effectiveness of the moisture transfer, it is necessary to carry out tests at low temperatures and controlled humidities. For these tests, the necessary test facilities were not available. Limited testing was carried out during winter conditions.

When operating the first model during the winter of 1985/86 with the outdoor air entering the unit at a temperature of 8° F. and when the average temperature of the discharged exhaust air was 29° F., no buildup of frost or ice was noticed in the air-to-air heat exchanger during a continuous 24 hours of operation on Jan. 27, 1986. The second model has not yet been tested at low temperature conditions. Because of the complex mass transfer mechanism involved, detailed predictions about the behaviour of the system are not possible.

The theoretical performance of the system in an R-2000 home was considered, the home having the following parameters:

Living area=186 $m^2$
Incoming air flow rate=3.35 lbs./h $m^2$
$Q_U$=100 BTU/h $m^2$
Temperature difference (interior/exterior)=60° F.
Humidity difference (interior/exterior)=0.0055 lbs. $H_2O$/lbs. dry air
Furnace efficiency=0.6

Initial results collected on the first model indicate that the moisture transfer effectiveness is about $E_{XS}$=0.3. With this moisture transfer effectiveness the performance characteristics of the system would be as follows:

CFE=0.84;
SHE=0.76;
$Q_F$=132 BTU/h $m^2$;
MRD=41.2 lbs. $H_2O$/day

For comparison, the performance characteristics of a condensing gas furnace ($E_F$=0.93) combined with a standard air-to-air heat exchanger ($E_{XS}$ =0.7, $E_{XL}$=0) in a conventional mode of operation (i.e. flue gases vented directly to the exterior) would be:

SHE=0.693;
$Q_F$=144 BTU/h $m^2$;
MRD=82.4 lbs. $H_2O$/day

Because no moisture is being transferred, CFE does not apply.

By way of further comparison, for a standard gas furnace with $E_F$=0.6 combined with a standard air-to-air heat exchanger and with the flue gases vented directly to the exterior, the performance characteristics would be:

SHE=0.448;
$Q_F$=223 BTU/h $m^2$;
MRD=82.4 lbs. $H_2$/day

Again, CFE does not apply.

To compare the fuel consumption for such an R-2000 home, the combination of the standard gas furnace ($E_F$=0.6) and air-to-air heat exchanger ($E_{XS}$=0.7, $E_{XL}$ =0) is assumed to represent 100% fuel consumption. Then, the combination of a condensing gas furnace with the same air-to-air heat exchanger reduces fuel consumption to 64.5% of the fuel used, while the use of the integrated heating and ventilating assembly of the present invention reduces fuel consumption to 59.2%.

The system of the present invention removes only about half the amount of moisture recovered from the occupied space, as compared to the two other combined systems. This is because there is no moisture transfer in the other systems. In increasing moisture transfer effectiveness, $E_{XL}$, the space heating efficiency of the present invention increases, but the amount of moisture removed from the occupied space decreases. At very low outdoor temperatures the removal of moisture from the occupied space, depending on the values of $E_{XL}$, may become the limiting factor for the space heating efficiency.

The combined fuel efficiency (CFE) and space heating efficiency (SHE) can be calculated from the various parameters of the system. They are found to be complex functions of fuel input, ventilation rate, sensible heat and moisture transfer effectiveness in the heat exchanger, indoor and outdoor air humidities and temperatures. Both efficiencies increase with: increasing fuel input, decreasing the ventilation rate; increasing of the effectiveness of the air-to-air heat exchanger; increasing of the outdoor humidity and temperature; and decreasing of the indoor humidity and temperature.

The amount of moisture removed from the occupied space is also a complex function of the ventilation rate, indoor and outdoor humidities, fuel input and moisture transfer effectiveness of the air-to-air air heat exchanger. It increases with the increase in the ventilation rate, with increasing indoor humidity and with reducing outdoor humidity and fuel input.

Consequently, control of the above parameters offers a control over the characteristics of the system and the efficiencies CFE, SHE as well as the moisture removal capacity MRD.

With regard to the heat exchanger, whilst a regenerative bed heat exchanger is shown, different heat exchanger designs could be used. The properties of the regenerative bed heat exchanger are discussed in greater detail in our copending patent application, mentioned above.

It is here mentioned that the heat transfer mechanisms for the sensible heat transfer and the latent heat transfer are quite different. The transfer of moisture may be by two mechanisms, one involving absorbtion-desorbtion, the other involving condensation evaporation. As the packed bed material does not possess the required absorbtion properties, moisture transfer is almost exclusively by condensation-evaporation. This requires the temperature of the bed material at the cold side to be significantly below the dew point temperature of the moist air and the air has to be relatively humid. Condensation then requires that fine particles of condensed moisture be formed in the air. Some of these are attracted by mechanical forces to the surface of the packed bed material, whilst the remainder are discharged in the air. This particle separation mechanism means that the moisture transfer effectiveness may not be related to the heat transfer effectiveness. $E_{XS}$ and $E_{XL}$ may be substantially different.

Another consideration for operation of the regenerative beds is that, during winter conditions, outdoor temperatures may drop much below the freezing point. As a result, rather than just moisture being formed, ice can form in the regenerative beds. Accordingly, the timing for the cycle for the beds should be chosen to ensure that, at the end of the heating portion of the cycle for a regenerative bed, the temperature of the exhausted air leaving the bed is above freezing. In other words, the cycle is sufficiently long to heat up the whole of the bed to above freezing. This would cause any ice that formed on the bed during the previous portion of the cycle, when outdoor air was passing through it, to melt. This moisture can then be re-evaporated during the next portion of the cycle to humidify the incoming air.

Experience with the first model, as reported in Table 1, shows that during 24 hours of continuous operation of the unit there is no evidence of ice buildup on the cold sides of the regenerative beds. Note that on the test run of Jan. 27, 1986, the temperature of the incoming air was well below the freezing point.

Whilst complete data and conclusions on the moisture transfer effectiveness are not presently available, it is believed that the regenerative beds will serve to enable moisture to be removed from the interior of the house, to maintain indoor air humidity at desired levels.

In winter conditions, the indoor humidity is low. Since the heat requirement for R-2000 homes is small, the dew point of the moist air drawn through the packed bed material is expected to be low. Under such conditions, the moisture transfer effective of the packed bed air-to-air heat exchanger is also expected to be low enough to permit enough moisture removal to maintain the indoor air humidity at desirable levels.

Reference will now be made to Table 3, which shows results from a third model made according to the heating and ventilating system described above. This third model was similar to the first two models in many ways. However, it was designed to serve houses built to the revised NBC code, i.e. houses requiring mechanical ventilation at an exchange rate of 0.5 ACH. Thus, the same regenerative beds were used, and the return line 140 and associated components included. The water heater 180 was not present. The furnace heat exchanger was built as a two clam shell unit, as shown. The atmospheric burners provide an input capacity in the range 30,000–45,000 BTU/h.

With reference to Table 3, as discussed above, both efficiencies CFE and SHE are complex functions of fuel input, ventilation rate, humidities and temperatures of the indoor and outdoor air. As test facilities simulating low outdoor temperatures were not available, collected data, set out in the table, are limited to outdoor conditions available during the test period.

As shown, the outdoor fresh air temperatures varied in a narrow range from 46°–64° F., for which the calculated CFE efficiency varied from 0.76 to 0.86. Under these conditions, there is no condensation of moisture and no moisture transfer between the two air streams. This is not representative of anticipated winter conditions. From the collected data and from a theoretical analysis of the system of the present invention, it is believed that the efficiencies CFE and SHE of this second unit are similar to those of the first unit.

Two packed bed heat exchanging materials were tested in the third model. These were ¾" limestone gravel and ¾" stone pebbles. As shown in Table 3, the stone pebbles have been found to be significantly more effective than the limestone gravel. In Table 3, the limestone gravel is designated Pack No. 1 and the stone pebbles Pack No. 2.

TABLE 1

SUMMARY OF DATA, UNIT B, MODEL 1, PERIOD: 1985–1986

| RUN DATE | INPUT $10^3$ BTU/h | HEAT EXCHANGER HOT STREAM IN (112b) °F. | HOT STREAM OUT (112a) °F. | COLD STREAM IN (113a) °F. | COLD STREAM OUT (113b) °F. | HEATER OUT (44) °F. | ROOM (137) °F. | HUMIDITIES $10^3$ lb $H_2O$/lb dry air 136 | 112a | 113a | 113b | 137 |
|---|---|---|---|---|---|---|---|---|---|---|---|---|
| OCT 18 | 11.11 | 155.5 | 92.5 | 76.4 | 138.6 | — | 76.4 | — | — | — | — | — |
| OCT 18 | 3.44 | 95.5 | 80.4 | 73.0 | 91.7 | — | 73.0 | — | — | — | — | — |
| OCT 18 | 3.44 | 105 | 82.0 | 75.0 | 96.2 | — | 75.0 | — | — | — | — | — |
| OCT 21 | 11.11 | 155 | 91.0 | 73.8 | 131.4 | + | 73.8 | — | — | — | — | — |
| OCT 21 | 11.11 | 186.6 | 93.3 | 72.2 | 156.6 | — | 72.2 | — | — | — | — | — |
| OCT 21 | 10.80 | 163.6 | 93.8 | 74.5 | 136.6 | — | 74.5 | — | — | — | — | — |
| OCT 25 | 5.66 | 127.0 | 72.3 | 57.0 | 108.9 | — | 72.3 | — | — | — | — | — |
| OCT 25 | 5.66 | 113.9 | 73.4 | 59.3 | 100.3 | — | 73.4 | — | — | — | — | — |
| NOV 13 | 10.4 | 113.4 | 66.2 | 49.1 | 96.5 | 154.7 | 78.5 | — | — | — | — | — |
| NOV 14 | 10.4 | 106.8 | 60.6 | 37.8 | 86.2 | 150.5 | 75.2 | 11.4 | 10.3 | 3.8 | 4.9 | 4.0 |
| NOV 14 | 10.4 | 107.4 | 61.5 | 39.5 | 84.4 | 150.0 | 76.0 | 13.0 | 9.9 | 4.2 | 6.5 | 4.0 |
| NOV 14 | 10.4 | 114.0 | 57.9 | 41.4 | 87.3 | 153.1 | 77.2 | 6.8 | 6.8 | 4.2 | 5.8 | 5.0 |
| NOV 22 | 10.2 | 119.2 | 67.7 | 35.8 | 92.2 | 153.8 | 92.0 | 20.4 | 13.1 | 3.3 | 7.7 | 18.7 |
| NOV 22 | 10.2 | 119.5 | 66.9 | 38.8 | 94.1 | 154.1 | 92.1 | 19.3 | 13.8 | 3.8 | 10.0 | 17.4 |
| NOV 22 | 10.2 | 118.6 | 68.0 | 38.8 | 92.5 | 152.0 | 92.0 | 20.3 | 13.3 | 4.0 | 8.2 | 18.5 |
| NOV 15 | 10.4 | 99.1 | 56.3 | 34.9 | 81.5 | 140.0 | 84.0 | 7.4 | 6.8 | 2.4 | 2.4 | 6.0 |
| NOV 20 | 10.2 | 121.0 | 73.6 | 46.7 | 93.5 | 154.8 | 96.2 | 25.5 | 18.0 | 2.6 | 6.4 | 23.0 |
| NOV 20 | 19.2 | 131.5 | 73.3 | 44.0 | 94.9 | 188.9 | 101.0 | 34.1 | 18.5 | 2.4 | 9.5 | 29.0 |
| NOV 21 | 10.2 | 118.7 | 68.8 | 35.9 | 93.1 | 134.6 | 90.0 | 21.0 | 14.0 | 1.9 | 4.4 | 19.5 |
| NOV 25 | 10.2 | 102.6 | 54.2 | 33.2 | 81.9 | 142.7 | 74.0 | 7.8 | 6.6 | 1.8 | 2.3 | 6.0 |
| NOV 25 | 10.2 | 103.5 | 54.4 | 34.0 | 83.5 | 143.8 | 74.5 | 7.8 | 6.6 | 1.8 | 2.2 | 6.0 |
| DEC 9 | 6.3 | 106.9 | 61.4 | 38.8 | 83.9 | 116.6 | 88.6 | 24.1 | 12.7 | 4.0 | 10.1 | 23.0 |
| JAN 27 | 6.3 | 81.9 | 29.0 | 8.7 | 65.2 | 94.5 | 61.0 | 0.0 | 3.0 | 0.6 | 2.0 | 6.0 |

AIR FLOWS SCFM

TABLE 1-continued

SUMMARY OF DATA, UNIT B, MODEL 1, PERIOD: 1985-1986

| RUN DATE | COLD IN (113a) | HOT OUT (112a) | EFFECTIVENESS $E_{XS}$ | $E_{XL}$ | CFE |
|---|---|---|---|---|---|
| OCT 18 | 192 | 195 | 0.796 | — | — |
| OCT 18 | 192 | 195 | 0.680 | — | — |
| OCT 18 | 160 | 160 | 0.706 | — | — |
| OCT 21 | 198 | 178 | 0.785 | — | — |
| OCT 21 | 125 | 113 | 0.815 | — | — |
| OCT 21 | 180 | 160 | 0.783 | — | — |
| OCT 25 | 102 | 97 | 0.781 | — | — |
| OCT 25 | 190 | 190 | 0.750 | — | — |
| NOV 13 | 160 | 160 | 0.734 | — | — |
| NOV 14 | 154 | 162 | 0.669 | — | 0.799 |
| NOV 14 | 135 | 135 | 0.676 | — | 0.788 |
| NOV 14 | 122 | 122 | 0.778 | — | 0.885 |
| NOV 22 | 120 | 130 | 0.618 | 0.33 | 0.771 |
| NOV 22 | 125 | 128 | 0.652 | 0.42 | 0.691 |
| NOV 22 | 135 | 145 | 0.633 | 0.33 | 0.653 |
| NOV 15 | 145 | 180 | 0.666 | — | 0.633 |
| NOV 20 | 135 | 120 | 0.637 | 0.29 | 0.699 |
| NOV 20 | 125 | 100 | 0.665 | 0.42 | 0.535 |
| NOV 21 | 135 | 155 | 0.603 | 0.32 | 0.554 |
| NOV 25 | 135 | 128 | 0.697 | 0.20 | 0.873 |
| NOV 25 | 135 | 128 | 0.702 | 0.20 | 0.873 |
| DEC 9 | 158 | 158 | 0.668 | 0.38 | 0.564 |
| JAN 27 | 135 | 135 | 0.770 | 0.20 | 0.676 |

$E_{XS}$ = sensible heat transfer effectiveness
$E_{XL}$ = moisture transfer effectiveness

TABLE 2

SUMMARY OF DATA, UNIT B, MODEL 2, PERIOD: 1986

| RUN DATE | INPUT $10^3$ BTU/h | HEAT EXCHANGER HOT STREAM IN (112b) °F. | HOT STREAM OUT (112a) °F. | COLD STREAM IN (113a) °F. | COLD STREAM OUT (113b) °F. | HEATER OUT (44) °F. | ROOM (137) °F. | HUMIDITIES $10^3$ lb $H_2O$/lb dry air 136 | 112a | 113a | 113b | 137 |
|---|---|---|---|---|---|---|---|---|---|---|---|---|
| APR 7 | 12.3 | 104.6 | 69.0 | 62.9 | 96.5 | 160 | 74.8 | — | — | — | — | — |
| APR 15 | 17.17 | 106.2 | 60.3 | 50.0 | 95.6 | 202 | 78.0 | — | — | — | — | — |
| APR 16 | 17.33 | 106.6 | 60.7 | 49.6 | 95.4 | 189.2 | 74.6 | — | — | — | — | — |
| APR 16 | 17.18 | 106.8 | 59.7 | 48.9 | 98.4 | 193.2 | 74.5 | — | — | — | — | — |
| APR 16 | 17.08 | 108.6 | 59.2 | 49.6 | 99.5 | 205.2 | 75.2 | — | — | — | — | — |
| APR 16 | 17.18 | 108.7 | 61.3 | 49.9 | 98.6 | 205.2 | 75.5 | — | — | — | — | — |
| APR 17 | 9.73 | 96.0 | 65.8 | 58.3 | 88.1 | 136.4 | 74.8 | — | — | — | — | — |
| APR 17 | 9.73 | 97.4 | 68.0 | 62.4 | 89.7 | 147.0 | 74.8 | — | — | — | — | — |
| APR 17 | 9.02 | 99.4 | 70.8 | 66.7 | 92.6 | 147.6 | 77.3 | — | — | — | — | — |
| APR 17 | 9.30 | 97.7 | 74.0 | 69.6 | 92.5 | 138.3 | 77.1 | — | — | — | — | — |
| APR 18 | 13.0 | 108.2 | 73.5 | 66.0 | 96.5 | 165.0 | 76.7 | — | — | — | — | — |
| APR 18 | 12.8 | 107.3 | 73.6 | 67.4 | 99.7 | 183.4 | 78.8 | — | — | — | — | — |
| APR 18 | 12.67 | 107.4 | 74.7 | 69.6 | 100.5 | 182.6 | 79.3 | — | — | — | — | — |
| APR 18 | 12.51 | 105.9 | 76.5 | 71.0 | 100.3 | 168.1 | 79.5 | — | — | — | — | — |
| APR 21 | 12.72 | 99.8 | 72.3 | 54.1 | 82.5 | 151.2 | 74.6 | — | — | — | — | — |
| APR 21 | 12.61 | 102.1 | 65.8 | 50.7 | 87.3 | 169.4 | 75.2 | — | — | — | — | — |
| APR 25 | 12.61 | 105.7 | 77.05 | 71.0 | 98.5 | 169.1 | 82.2 | 10.2 | 10.2 | 4.5 | 4.5 | 8.5 |
| APR 25 | 12.6 | 108.4 | 82.7 | 76.2 | 102.4 | 173.7 | 85.0 | 16.2 | 16.2 | 10.2 | 10.2 | 14.2 |

| RUN DATE | AIR FLOWS SCFM COLD IN (113a) | HOT OUT (112a) | EFFECTIVENESS $E_{XS}$ | $E_{XL}$ | CFE |
|---|---|---|---|---|---|
| APR 7 | 158 | 156 | 0.854 | — | 0.892 |
| APR 15 | 158 | 158 | 0.816 | — | 0.819 |
| APR 16 | 158 | 155 | 0.805 | — | 0.822 |
| APR 16 | 155 | 155 | 0.854 | — | 0.928 |
| APR 16 | 138 | 158 | 0.845 | — | 0.906 |
| APR 16 | 138 | 138 | 0.828 | — | 0.898 |
| APR 17 | 155 | 155 | 0.801 | — | 0.840 |
| APR 17 | 126 | 126 | 0.840 | — | 0.827 |
| APR 17 | 120 | 120 | 0.876 | — | 0.861 |
| APR 17 | 158 | 158 | 0.843 | — | 0.871 |
| APR 18 | 158 | 158 | 0.798 | — | 0.887 |
| APR 18 | 125 | 125 | 0.845 | — | 0.858 |
| APR 18 | 125 | 125 | 0.865 | — | 0.890 |
| APR 18 | 158 | 158 | 0.844 | — | 0.900 |
| APR 21 | 150 | 150 | 0.601 | — | 0.815 |
| APR 21 | 122 | 122 | 0.706 | — | 0.815 |
| APR 25 | 125 | 125 | 0.825 | 0.0 | 0.82 |

TABLE 2-continued

| SUMMARY OF DATA, UNIT B, MODEL 2, PERIOD: 1986 | | | | | | | |
|---|---|---|---|---|---|---|---|
| | APR 25 | 158 | 158 | 0.800 | 0.0 | 0.874 |

$E_{XS}$ = sensible heat transfer effectiveness
$E_{XL}$ = moisture transfer effectiveness

TABLE 3

SUMMARY OF DATA, UNIT C

| RUN DATE 1986 | INPUT $10^3$ BTU/h | $CO_2$ | CO ppm | AIR FLOWS CFM (112a) | AIR FLOWS CFM (113a) | OP. TIME MIN. | AIR TEMPERATURES °F. FRESH AIR IN (113a) | FRESH AIR OUT (44) | ROOM AIR IN (137) | ROOM AIR OUT (112a) | HUMIDITIES lb $H_2O$/lb dry air 113a | 112a | 137 | CFE | PACK NO. |
|---|---|---|---|---|---|---|---|---|---|---|---|---|---|---|---|
| OCT 08 | 40.5 | 6.0 | 27 | 160 | 160 | 4.9 | 55.6 | 177.3 | 73.0 | 78.0 | 0.004 | 0.012 | 0.004 | 0.802 | 1 |
| OCT 09 | 37.0 | 5.4 | 30 | 160 | 160 | 4.9 | 46.9 | 177.4 | 75.0 | 75.6 | 0.003 | 0.011 | 0.003 | 0.763 | 1 |
| OCT 10 | 36.8 | 5.2 | 30 | 160 | 160 | 4.9 | 46.1 | 180.0 | 76.7 | 75.6 | 0.003 | 0.011 | 0.003 | 0.759 | 1 |
| OCT 10 | 36.5 | 5.0 | 26 | 158 | 158 | 4.9 | 47.4 | 177.6 | 75.1 | 75.3 | 0.004 | 0.011 | 0.004 | 0.766 | 1 |
| OCT 15 | 36.4 | 5.0 | 30 | 160 | 160 | 4.9 | 54.8 | 177.1 | 76.3 | 81.4 | 0.007 | 0.013 | 0.007 | 0.770 | 1 |
| OCT 20 | 37.2 | 5.0 | 30 | 160 | 160 | 4.9 | 63.5 | 182.6 | 76.5 | 76.8 | — | 0.012 | — | 0.836 | 2 |
| OCT 21 | 37.5 | 4.5 | 22 | 160 | 160 | 4.9 | 59.8 | 183.4 | 76.6 | 73.6 | 0.008 | 0.014 | 0.008 | 0.834 | 2 |
| OCT 21 | 37.3 | 5.5 | 30 | 135 | 135 | 4.9 | 63.2 | 188.2 | 77.9 | 76.5 | — | — | — | 0.864 | 2 |
| OCT 22 | 37.6 | 5.8 | 60 | 135 | 135 | 33.0 | 64.9 | 184.1 | 77.7 | 88.8 | — | — | — | 0.804 | 2 |
| OCT 23 | 37.3 | 5.7 | 30 | 135 | 135 | 15.4 | 58.8 | 185.1 | 74.9 | 77.3 | — | — | — | 0.825 | 2 |
| OCT 27 | 37.5 | 5.8 | 28 | 135 | 135 | 20.7 | 56.1 | 178.2 | 71.5 | 79.2 | — | — | — | 0.807 | 2 |
| OCT 28 | 37.7 | — | — | 135 | 135 | 20.5 | 60.4 | 188.7 | 76.7 | 80.6 | 0.004 | 0.016 | 0.004 | 0.820 | 2 |
| OCT 29 | 37.8 | — | — | 135 | 135 | 20.5 | 60.0 | 188.8 | 76.5 | 80.9 | 0.009 | 0.018 | 0.009 | 0.816 | 2 |
| OCT 31 | 37.8 | 5.7 | 30 | 135 | 135 | 10.4 | 52.1 | 180.3 | 75.9 | 73.2 | 0.004 | 0.013 | 0.004 | 0.816 | 2 |

I claim:

1. A heating and ventilating system for a building, the heating and ventilating system comprising:

a space heating device in which heat is generated by combustion of a fuel for heating air within a building, and which includes a heater inlet and a heater outlet for opening into the interior of a building:

a first exhaust conduit for the combustion products connected to the space heating device;

a heat exchanger comprising one path for exhaust gases from the building interior which has one inlet and one outlet to the exterior, and another path for exterior air which has another inlet and another outlet connected to the heater inlet; and an exhaust air line connected to said one inlet for connecting to the interior of the building and including a connection to the first exhausted conduit, whereby the exhaust gases transferring heat to the incoming exterior air in the heat exchanger comprise exhaust interior air and combustion products.

2. A heating and ventilating system as claimed in claim 1, which includes a first, exhaust blower mounted for driving gases through said one side of the heat exchanger, and a second, inlet blower mounted for driving air through the other path of the heat exchanger.

3. A heating and ventilating system as claimed in claim 2, wherein the first, exhaust blower is connected to said one outlet of the one path of the heat exchanger and the second, inlet blower is connected to said other inlet of the other path of the heat exchanger, whereby a pressure below atmospheric pressure can be maintained in said one path of the heat exchanger and a pressure above atmospheric pressure can be maintained in the said other path of the heat exchanger.

4. A heating and ventilating system as claimed in claim 3, wherein an air filter is provided at an inlet to the second, inlet blower, and an air filter is provided at an inlet to the exhaust air line.

5. A heating and ventilating system as claimed in claim 3, wherein the heat exchanger comprises: first and second regenerative beds, each having two inlet/outlet openings; a first 4-way valve having a first port for discharging exhaust air to the exterior, a second port for drawing fresh air from the exterior, a third port connected to one inlet/outlet opening of the first regenerative bed, and a fourth port connected to one inlet/outlet opening of the second regenerative bed; a second 4-way valve having a first port connected to the exhaust air line, a second port connected to the heater inlet, a third port connected to the other inlet/outlet opening of the first regenerative bed and a fourth port connected to the other inlet/outlet opening of the second regenerative bed, each of the 4-way valves being switchable between a first position in which the first port is connected to the third port and the second port is connected to the fourth port, and a second position in which the first port is connected to the fourth port and the second port is connected to the third port; and wherein the valves are actuated together so that, in the first position of the valves, the exhaust air line is connected through the first regenerative bed to the exterior and the second port of the first valve is connected through the second regenerative bed to the heater intake, and in the second position of the valves, the exhaust air line is connected through the second regenerative bed to the exterior and the second port of the first valve is connected through the first regenerative bed to the heater inlet.

6. A heating and ventilating system as claimed in claim 5, wherein the regenerative beds comprise a generally granular material of sufficient size and thermal characteristics, to provide required air flow characteristics and sensible and latent heat transfer characteristics.

7. A heating and ventilating system as claimed in claim 6, wherein the granular material of each regenerative bed comprises gravel.

8. A heating and ventilating system as claimed in claim 6 or 7, wherein each regenerative bed includes a central chamber containing the granular material and two manifold chambers on either side of the central chamber, with the manifold chambers being separated from the central chamber by perforated screens and with each manifold chamber including a respective inlet/outlet opening.

9. A heating and ventilating system as claimed in claim 6 or 7, wherein each regenerative bed comprises a central chamber containing the granular material and two manifold chambers on either side of the central chamber, with manifold chambers being separated from the central chamber by perforated screens and with each manifold chamber including a respective inlet/outlet opening, and wherein the regenerative beds are provided side-by side in a common housing.

10. A heating and ventilating system as claimed in claim 5, wherein the first and second valves each include an actuating rod, and wherein there is provided a cross member connecting the actuating rods and a single, common actuator for displacing the cross member and actuating rods.

11. A heating and ventilating system as claimed in claim 10, wherein the actuator is a hydraulic actuator.

12. A heating and ventilating system as claimed in claim 5, wherein the first, exhaust blower is connected to the first port of the first valve and the second, inlet blower is connected to the second port of the first valve, and wherein an air filter is provided at the inlet of the second, inlet blower and an air filter is provided at an inlet to the exhaust air line.

13. A heating and ventilating system as claimed in claim 1, 4 or 5, which includes a water heater, in which heat is generated by combustion of a fuel, and a second exhaust conduit, for combustion products of the water heater, connected to the water heater and to the exhaust line, whereby the exhaust gases passing through the heat exchanger include the combustion products of the water heater.

14. A heating and ventilating system as claimed in claim 2, which includes a first fuel control valve, controlling fuel flow to the space heating device, and a control unit connected to the first fuel control valve for control thereof.

15. A heating and ventilating system as claimed in claim 5, which includes a fuel control valve for controlling fuel supply to the space heating device, and a control unit connected to the control valve for control thereof.

16. A heating and ventilating system as claimed in claim 14 which includes a water heater, in which heat is generated by combustion of a fuel, a second exhaust conduit, for combustion products of the water heater, connected to the water heater and the exhaust line, so that exhaust gases passing through the heat exchanger include combustion products from the water heater, and a second fuel control valve for controlling fuel supply to the water, which second fuel control valve is connected to and controlled by the control unit.

17. A heating and ventilating system as claimed in claim 14, 15 or 16, which includes a flow sensor disposed in the exhaust air line and connected to the control unit, the control unit closing each fuel control valve in the absence of sufficient air flow sensed by the flow sensor.

18. A heating and ventilating system as claimed in claim 2, which includes a return air line connected to the exhaust air line at a junction therebetween and a recirculation line extending from that junction to the heater inlet.

19. A heating and ventilating system as claimed in claim 5, which includes a return air line connected to the exhaust air line at a junction therebetween, and a recirculation line extending from that junction to the heater inlet.

20. A heating and ventilating system as claimed in claim 12, which includes a return air line connected to the exhaust air line at a junction therebetween, and a recirculation line extending from that junction to the heater inlet.

21. A heating and ventilating system as claimed in claim 18, 19 or 20, which includes a recirculation blower in the recirculation line.

22. A heating and ventilating system as claimed in claim 18, 19 or 20, which includes a recirculation blower and a non-return valve in the recirculation line, the non-return valve only permitting air flow towards the heater inlet.

23. A heating and ventilating system as claimed in claim 18, 19 or 20, which includes a recirculation blower and a non-return valve in the recirculation line, the non-return valve only permitting air flow towards the heater inlet, and which further includes a fuel control valve for controlling fuel supply to the space heating device, a control unit connected to the fuel control valve for control thereof and a flow sensor in the exhaust air line upstream from the point at which the exhaust conduit opens into the exhaust air line, the flow sensor being connected to the control unit and the control unit closing the fuel valve in the absence of sufficient flow within the exhaust air line.

* * * * *